United States Patent [19]

Orth

[11] Patent Number: 4,523,066

[45] Date of Patent: Jun. 11, 1985

[54] AUTOMOTIVE AIR CONDITIONING SYSTEM CONTROLLED BY DAMPED PRESSURE SWITCH

[75] Inventor: Charles D. Orth, Lake Forest, Ill.

[73] Assignee: The Singer Company, Stamford, Conn.

[21] Appl. No.: 628,669

[22] Filed: Jul. 6, 1984

Related U.S. Application Data

[62] Division of Ser. No. 355,628, Mar. 8, 1982.

[51] Int. Cl.[3] ..... H01H 35/34

[52] U.S. Cl. ..... 200/83 S; 62/288; 138/44; 200/83 T

[58] Field of Search ..... 200/83 R, 83 WM, 83 A, 200/83 B, 83 C, 83 D, 83 F, 83 J, 83 L, 83 N, 83 P, 83 Q, 83 S, 83 SA, 83 T, 83 V, 83 Y, 83 W, 83 Z; 138/40, 44

[56] References Cited

U.S. PATENT DOCUMENTS 1,414,913 5/1922 Whittingham ..... 200/83 C

*Primary Examiner*—A. D. Pellinen
*Assistant Examiner*—Morris Ginsburg
*Attorney, Agent, or Firm*—David L. Davis; Robert E. Smith; Edward L. Bell

[57] ABSTRACT

The electrically operated clutch controlling operation of the compressor is regulated by a damped pressure switch. The pressure switch has a diaphragm which moves in response to pressure variation to actuate the switch. The force acting on the diaphragm is opposed by spring force. The housing is provided with a damping chamber between the diaphragm chamber and the restricted passage in the inlet. The restricted passage is the clearance between the hole drilled in the metal insert and the wire fixed in the hole. The restriction is selected relative to the damping chamber so the switch will not cycle more than four times per minute when sensing pressure at the outlet of a finned coil evaporator in an automotive air conditioning system operating under light load.

6 Claims, 3 Drawing Figures

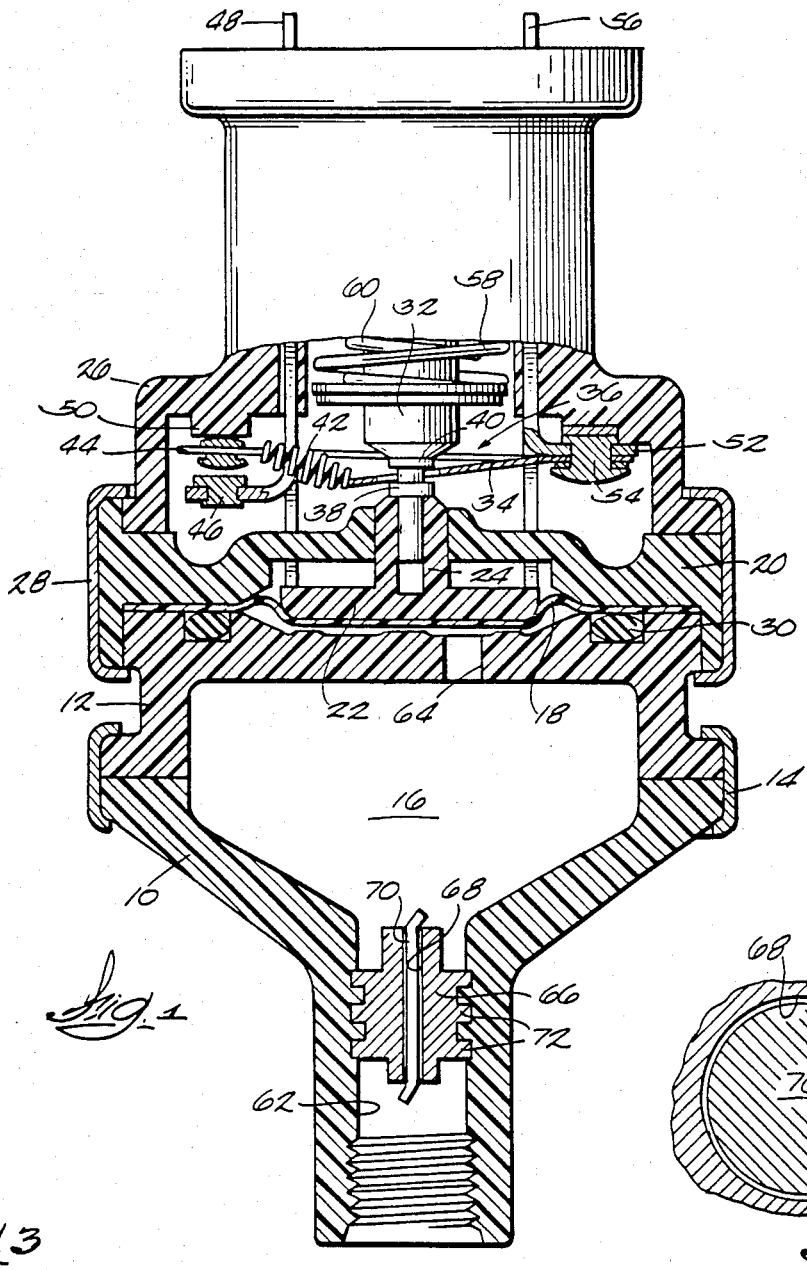
Fig. 1
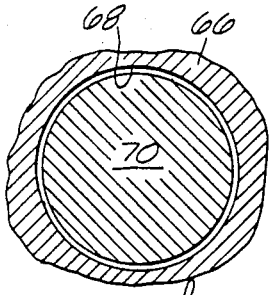
Fig. 2
Fig. 3
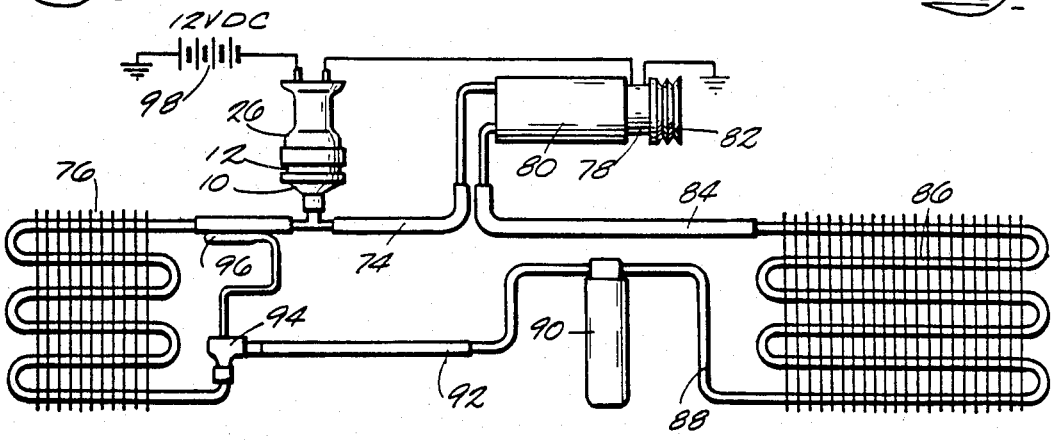

AUTOMOTIVE AIR CONDITIONING SYSTEM CONTROLLED BY DAMPED PRESSURE SWITCH

This application is a division of application Ser. No. 355,628, filed Mar. 8, 1982.

BACKGROUND OF THE INVENTION

To improve fuel economy automotive air conditioning systems control compressor operation to avoid unnecessary cooling and to avoid icing the evaporator. The clutch between the engine and the compressor is controlled by either a thermostatic switch or a pressure switch with the pressure switch having cost and installation advantages. Use of the pressure switch has been confined to flooded evaporator type systems where the pressure changes slowly. In a finned coil evaporator, the pressure changes rapidly when the compressor starts and a pressure switch causes the clutch to cycle too fast. Therefore, finned coil systems have used the less desireable thermostatic switch.

SUMMARY OF THE INVENTION

The principal object of this invention is to control compressor operation in an automotive air conditioning system having a finned coil evaporator by means of a pressure switch. This is accomplished by providing a damped pressure switch. The switch is damped so the compressor will not cycle more than four times per minute under low load conditions. Thus, the system cycles at about the same rate as when controlled by a thermostatic switch. The pressure switch must be highly damped and no such pressure switch existed.

Accordingly, another object of this invention is to provide a damped pressure switch for use in automotive air conditioning systems using finned coil evaporators. The restricted passage in the inlet to the damped pressure chamber under the diaphragm has such a small area and is so long as to be virtually impossible to drill on a production basis. I drill a relatively large hole and fix a pin of known diameter in the hole so the clearance is the restricted passage. The pin can be made of wire. Wire diameter is quite exact. It is relatively easy to make a very restricted passage which can be "tuned" to the air conditioning system to give the desired lag when the compressor starts operation. The damped pressure switch does not slow down the response to rising pressure after the compressor stops since the system pressure rises slowly and the pressure in the damped chamber keeps up. Thus the trip point (when the compressor starts) can be sensed more accurately than with a thermostatic switch. In effect the pressure switch is damped only as the system pressure falls.

BRIEF DESCRIPTION OF THE DRAWINGS

FIG. 1 is a vertical section through the damped pressure switch.

FIG. 2 is a greatly enlarged section through the restrictor shown in the inlet in FIG. 1, and FIG. 3 is a schematic showing of an automotive air conditioning system using the damped pressure switch.

DETAILED DESCRIPTION OF THE DRAWINGS

The pressure switch housing has a lower portion 10 connected to the intermediate portion 12 by a clamp ring 14 and define, in cooperation with the intermediate portion, the damping chamber 16. Diaphragm 18 is clamped between the intermediate portion 12 and the partition housing portion 20 with diaphragm pad 22 resting on top of the diaphragm with an upwardly extending boss 24 slidably guided in the central bore of partition 20. The upper housing part 26 is mounted on top of the partition 20. The upper housing 26, the partition 20 and the intermediate housing 12 are connected together by a clamp ring 28. The space under the diaphragm 18 is sealed by O-ring 30 mounted in the groove in the partition and compressed against the rim of the diaphragm. The diaphragm is preferably a thin plastic film diaphragm of the type described in detail in U.S. Pat. No. 4,456,801, issued June 26, 1984.

The lower end of actuator 32 fits inside boss 24 and the tongue 34 of switch 36 engages the actuator between shoulders 38, 40 so that movement of the actuator will move the tongue. When the barrel spring 42 compressed between the end of tongue 34 and cross member 44 of the switch blade goes over center the contact carrying end 44 of the switch will snap down to engage contact 46 which is supported by the terminal structure projecting through the upper housing part and terminating in connector 48. In the position shown in the drawing, the switch contact bears against a boss 50 molded in the upper housing part. The other end of the switch blade is connected to terminal arm 52 by rivet 54 and this terminal also projects through the upper housing to provide connector 56.

The actuator is biased downwardly by two springs designated a reset spring 58 and a trip spring 60. These springs are preferably arranged as shown in the aforesaid patent, and for the purpose of understanding this invention the details of construction and assembly are unimportant. Suffice it to say that as the diaphragm rises with increasing pressure both springs become operative to oppose diaphragm movement before the switch snaps over center from the position shown in FIG. 1 to make contact with the fixed contact 46 and thus complete the electric circuit between the connectors 48 and 56. On the return stroke as the pressure under the diaphragm decreases trip spring 60 becomes inoperative or ineffective before the switch snaps from fixed contact 46 back to the inert boss 50. Therefore, the trip force is determined by the force of both springs while the reset force is determined only by spring 58. It is emphasized that for the purpose of this invention any spring arrangement can be used although that just described briefly (and more fully described in the aforesaid patent) is deemed preferable.

The lower housing 10 is provided with an inlet 62 which is connected to the suction line 74 leading from the outlet of the finned tube evaporator 76 in the automotive air conditioning system shown in FIG. 3. Inlet 62 leads to damping chamber 16 and the damping chamber is connected to the space under the diaphragm by passage 64. As previously indicated, in a finned tube evaporator coil type of automotive air conditioning system the pressure of the evaporator outlet drops quite rapidly when the compressor operates and the air conditioning load on the system is light. Normally, the sequence is as follows. When the compressor does not operate, the pressure in the system at the evaporator outlet will rise to the point where the diaphragm actuates the switch to go over center and complete the electric circuit. This engages clutch 78 in the automotive air conditioning system to cause the compressor 80 to operate. Under light load conditions the compressor has excess capacity and therefore the pressure draws down very rapidly at the evaporator outlet. If the pressure switch has fast response to the rapid drop, the switch would go over center (to shut off the compressor) in a short period of time and the pressure switch would soon thereafter sense a high pressure. As a result the clutch would be cycled quite frequently. This is indesirable. Generally, under light load conditions the clutch should not desirably cycle more than four times a minute. The pressure drop is fast and if the switching is delayed no harm is done. When the clutch is disengaged, the pressure will rise but the rise is much slower than the drop.

To slow down or damp the response of the pressure switch a restriction is put in the inlet 62 leading to the damping chamber 16. Restriction takes the form of a metal insert 66 through which hole 68 is drilled. It is virtually impossible to drill a small enough hole to achieve an adequate restriction leading to the damping chamber 16. Therefore, the hole is made of a size which can be drilled easily and then a pin 70 made from wire is mounted in the hole by bending the ends to prevent the pin from dropping out of the hole. Wire sizes are very accurately dimensioned. Therefore, the wire diameter can be selective relative to the diameter of the hole so that the clearance between the wire and the hole will determine the restriction. The effective restriction is also affected by the length of the restriction. The amount of restriction required to achieve the desired maximum of four cycles per minute of the switch or clutch in the air conditioning system is also affected by the volume of the damping chamber. If the volume is small the restriction has to be greater. Tests demonstrate that a damping chamber of 0.57 cu. ins. volume in combination with a restricted orifice (hole) of 0.032 inches diameter by approximately 0.25 inches long with a pin of 0.029 inches diameter gave a satisfactory cycling frequency at low air conditioning load conditions. Thus, a satisfactory result is attained when the length of the restricted passage is about 1700 times the area of the restricted passage. Tests also indicate that the performance is improved if with the same orifice and pin arrangement the chamber volume is increased to 1.0 cu. in. Thus, with the test conditions chamber volume to effective orifice area (area of the hole minus area of the pin) can range between 3,000 and 7,000. If a longer orifice or restrictive passage is used, the chamber volume can be reduced. The insert 66 is machined to provide three fins or ribs 72 to secure a better seal of the insert 66 to the plastic housing 10. The housing is molded onto the insert 66. The insert is metal to insure accurate dimensioning of the hole. The requisite accuracy cannot be obtained on a reliable basis by trying to machine or mold a hole in a plastic part. Thus, with an accurate hole drilled in a metal insert 66 and an accurately sized pin mounted in the hole the clearance or restricted passage will be very accurate and repeatable. The length of the insert 66 and hence the length of the hole is another easily maintained dimension.

The pressure switch controls the electrically operated clutch beween the input 82 and the compressor 80. The input 82 is driven by V-belts from the engine (not shown). The compressor discharge line 84 leads to the condenser coil 86 which discharges through conduit 88 leading to the dehydrator/receiver 90. Flow from the receiver through conduit 92 to the evaporator 76 is controlled by thermostatic expansion valve 94 which regulates flow to the evaporator in accordance with the temperature at the evaporator outlet as sensed by the feeler bulb 96 strapped on the suction line. The pressure switch when closed completes the circuit to the clutch from battery 98. With the damped pressure switch controlling the clutch (and therefore the compressor operation) the system operates as well or better than one with a thermostatic switch. Under light conditions when the pressure causes the switch to close the pressure in the suction line 74 drops very rapidly but the pressure switch does not respond rapidly due to the damped response. When the switch finally opens the pressure in the suction line rises slowly and the pressure change in the damping chamber 16 keeps pace. In effect the pressure switch damps response to the fast drop—it does not damp the response to the slow rise. And the pressure switch in effect has a normal response to the pressure changes in normal load operation of the system. In effect, the pressure switch delays response only under the conditions where delay is desired.

I claim:

1. A pressure switch having a diaphragm mounted in a housing to move in response to pressure changes in a chamber communicating with an inlet, movement of the diaphragm being operative to actuate a switch, wherein the improvement comprises:

a partition between the inlet and the chamber, a hole in the partition, and a pin mounted in the hole with clearance between the pin and the hole, the clearance being a restricted passage retarding pressure change in the chamber when pressure at the inlet changes rapidly.

2. A pressure switch according to claim 1 in which the partition is metal and the housing is molded onto the partition.

3. A pressure switch according to claim 2 in which the pin projects through the partition and the ends of the pin are bent to prevent the pin from falling out of the hole.

4. A pressure switch according to claim 1 in which the ratio of chamber volume to the area of the restricted passage is between approximately 3,000 and 7,000.

5. A pressure switch according to claim 4 in which the length of the restricted passage is about 1,700 times the area of the restricted passage.

6. A pressure switch according to claim 1 and adapted to have its inlet connected to the evaporator outlet in an automotive air conditioning system, wherein the chamber volume and the length and area of the restricted passage are selected so the switch will not cycle more than four times per minute when the inlet is so connected.

* * * * *